US012546574B2

(12) United States Patent
Cohen

(10) Patent No.: US 12,546,574 B2
(45) Date of Patent: Feb. 10, 2026

(54) INTERCEPTOR

(71) Applicant: David Cohen, Herzliya (IL)

(72) Inventor: David Cohen, Herzliya (IL)

( * ) Notice: Subject to any disclaimer, the term of this patent is extended or adjusted under 35 U.S.C. 154(b) by 0 days.

(21) Appl. No.: 17/983,421

(22) Filed: Nov. 9, 2022

(65) Prior Publication Data

US 2023/0073113 A1 Mar. 9, 2023

Related U.S. Application Data

(63) Continuation of application No. PCT/IL2022/050712, filed on Jul. 4, 2022.

(30) Foreign Application Priority Data

Jul. 4, 2021 (IL) ..... 284594

(51) Int. Cl.

| | |
|---|---|
| ***F42B 12/52*** | (2006.01) |
| ***F41H 11/02*** | (2006.01) |
| ***F42B 5/145*** | (2006.01) |
| ***F42B 5/15*** | (2006.01) |
| ***F42B 12/48*** | (2006.01) |
| ***F42B 12/70*** | (2006.01) |

(52) U.S. Cl.

CPC ..... *F42B 5/15* (2013.01); *F41H 11/02* (2013.01); *F42B 12/48* (2013.01); *F42B 12/70* (2013.01)

(58) Field of Classification Search

CPC ..... F42B 12/52

See application file for complete search history.

(56) References Cited

U.S. PATENT DOCUMENTS

| | | | | | |
|---|---|---|---|---|---|
| 3,570,401 | A * | 3/1971 | Euker | F42B 12/52 | 102/363 |
| 3,596,603 | A * | 8/1971 | Gryting | F42B 12/50 | 102/363 |
| 3,730,093 | A * | 5/1973 | Cummings | F42B 12/44 | 102/363 |
| 3,967,553 | A * | 7/1976 | Keraus | C06B 43/00 | 102/495 |
| 3,999,482 | A * | 12/1976 | Bilek | F42B 12/52 | 102/363 |
| 4,023,492 | A * | 5/1977 | Kempton | F42B 12/202 | 102/701 |

(Continued)

FOREIGN PATENT DOCUMENTS

| | | | | |
|---|---|---|---|---|
| DE | 3831329 A * | 4/1990 | ..... | F42B 12/52 |
| DE | 3903096 A * | 8/1990 | ..... | F42B 12/52 |

(Continued)

OTHER PUBLICATIONS

International Search Report and the Written Opinion Dated Oct. 18, 2022 From the International Searching Authority Re. Application No. PCT/IL2022/050712. (12 Pages).

(Continued)

*Primary Examiner* — Derrick R Morgan

(57) ABSTRACT

Device for interception of incoming ordnance, comprises a dispersion unit to disperse an explosive cloud in an expected path of the incoming ordnance, a proximity detector to detect proximity of the incoming ordnance in relation to the explosive cloud; and an ignition unit associated with said proximity detector that ignites the explosive cloud to disrupt the incoming ordnance.

21 Claims, 20 Drawing Sheets

(56) References Cited

U.S. PATENT DOCUMENTS 4,074,628 A * 2/1978 Manning ..... F42B 12/52 102/363
4,141,294 A * 2/1979 Zaharia ..... F42C 15/295 102/363
4,157,928 A * 6/1979 Falterman ..... C06B 43/00 102/363
4,297,949 A * 11/1981 Glass ..... F41H 11/12 102/363
4,302,208 A * 11/1981 Wood ..... C10L 7/04 102/363
4,463,680 A * 8/1984 Sayles ..... F42B 12/52 102/363
4,493,262 A * 1/1985 Hutcheson ..... F42B 12/52 102/363
5,495,787 A * 3/1996 Boyer, III ..... F41H 11/02 102/293
5,852,256 A * 12/1998 Hornig ..... F42B 12/204 102/493
6,293,201 B1 * 9/2001 Consaga ..... F42B 12/52 102/494
6,958,813 B1 * 10/2005 Ahmadjian ..... G01N 21/31 356/336
7,377,217 B2 * 5/2008 Swanson ..... F41H 11/02 102/370
7,614,348 B2 * 11/2009 Truitt ..... F42B 12/32 102/497
8,833,231 B1 * 9/2014 Venema ..... F41G 3/165 89/204
8,894,783 B2 * 11/2014 Dixon ..... C06B 27/00 102/363
2004/0129162 A1 * 7/2004 Lloyd ..... F42C 19/095 102/494
2009/0173250 A1 7/2009 Marscher
2012/0217301 A1 * 8/2012 Namey ..... F41G 3/04 235/411
2013/0125656 A1 * 5/2013 Tillotson ..... F42D 5/045 73/599
2014/0182473 A1 * 7/2014 Dixon ..... F42B 12/52 102/363
2019/0013105 A1 * 1/2019 Drexler ..... F42B 12/52

FOREIGN PATENT DOCUMENTS

EP 2453199 6/2014
GB 2392487 3/2004
WO WO 2023/281498 1/2023

OTHER PUBLICATIONS

Supplementary Partial European Search Report and the European Provisional Opinion Dated Apr. 29, 2025 From the European Patent Office Re. Application No. 22837168.8. (11 Pages).

Supplementary European Search Report and the European Search Opinion Dated Jul. 24, 2025 From the European Patent Office Re. Application No. 22837168.8. (11 Pages).

* cited by examiner

INTERCEPTOR

RELATED APPLICATIONS

This application is a Continuation of PCT Patent Application No. PCT/IL2022/050712, having international filing date of Jul. 4, 2022, which claims the benefit of priority of Israel Patent Application No. 284594 filed on Jul. 4, 2021. The contents of the above applications are all incorporated by reference as if fully set forth herein in their entirety.

FIELD AND BACKGROUND OF THE INVENTION

The present invention, in some embodiments thereof, relates to protection against incoming threats such as anti-tank ordnance, other missile threats and drones.

It is known to use small high explosive charges which get close to the incoming threat and explode. The charges have to be small so that the device is kept light and maneuverable to catch the incoming threat, which itself may be highly maneuverable, and due to the small size of the charge, a high level of precision is needed to effectively deal with the threat. The explosion must therefore take place in very close proximity of the target threat, even though the threat is maneuvering, hence requiring high precision and timing. Sometimes a proximity of half a meter is necessary, or even less. The explosion causes a pressure wave which is initially very high, but recedes very rapidly with distance. Fragments of the explosion may cause additional damage.

SUMMARY OF THE INVENTION

The present embodiments provide an explosive cloud which dispersed on or near the path of the incoming ordnance and which is detonated as the incoming ordnance approaches. The cloud may be made up of an aerosol of fuel or other energizing agent, optionally accompanied by an oxidizer.

Herein the term 'explosive' is used for the cloud and also for the energetic material forming the cloud.

In the past it has not been possible to use such a cloud to defeat incoming ordnance as the cloud does not have time to form and ignite before the ordnance has already passed. The present embodiments detect the ordnance and determine a predicted path and timing. The cloud is then set up based on the predicted path and detonated in accordance with the predicted timing. It is noted that in the case of guided ordnance, the predicted path may have some degree of freedom. The spreading of the cloud is intended to cover corrections introduced by the guidance system in use.

Furthermore a cloud-based explosion lasts longer in time and covers greater area than a point explosion carried out by a regular high-explosive warhead. Pressure changes are continuous throughout the cloud for the full duration.

Furthermore the cloud generally forms an explosion that typically surrounds the incoming ordnance and hence impacts it from all directions. However even if the ordnance manages to avoid the cloud it may still be impacted by the pressure wave at least from one direction.

The cloud is initially formed by dispersal of the explosive medium using a dispersal mechanism, which may be pyrotechnic, say an explosive device that releases the material, or mechanical dispersal may be used.

According to one aspect of the present embodiments there is provided a device for interception of incoming ordnance, comprising:

detecting an incoming ordnance.

a dispersion unit configured to disperse an explosive cloud in an expected path of the incoming ordnance;

a detector configured to detect incoming ordnance in relation to the explosive cloud; and an ignition unit associated with the proximity detector and configured to ignite the explosive cloud to disrupt the incoming ordnance.

In embodiments, the dispersion unit is a launchable canister. The launchable canister may be rocket propelled, or may be designed for firing from a gun. Rocket launchers or guns may be vehicle mounted, or mounted on ground installations, or may be hand held, or provided in any other suitable way.

In a further alternative, the dispersion unit may be a hose, and/or may be carried on a vehicle.

In embodiments, the explosive cloud comprises droplets of gasoline.

The gasoline may be aviation fuel or any other high octane fuel.

The gasoline may be dispersed as an aerosol.

The explosive cloud may have explosive powder, for example aluminum powder.

According to a second aspect of the present invention there is provided a method for interception of incoming ordnance, comprising:

detecting an incoming ordnance.

dispersing an explosive cloud in an expected path of the incoming ordnance;

detecting proximity of the incoming ordnance in relation to the explosive cloud; and when the incoming ordnance is within a predetermined proximity of the explosive cloud, igniting the explosive cloud to disrupt the incoming ordnance.

The method may comprise detecting a wind speed and direction and using the wind speed and direction to modify the predetermined proximity. Additionally or alternatively the method may comprise modifying a location in which the cloud is dispersed to intercept the path. Additionally or alternatively the method may comprise detecting temperature, or humidity, or barometric pressure, and modifying the predetermined proximity or modifying a dispersal location accordingly, again to intercept the path.

According to a third aspect of the present invention there is provided apparatus for clearing an area around an armored vehicle advancing through obstructions, the obstructions obscuring line of sight from the armoured vehicle, comprising:

a dispersion unit configured to disperse an explosive cloud around the armoured vehicle; and an ignition unit associated with the armoured vehicle and configured to ignite the explosive cloud to explode into the obstructions.

According to a fourth aspect of the present invention there is provided a method for clearing an area around an armored vehicle advancing through obstructions, the obstructions obscuring line of sight from the armored vehicle, the method comprising:

dispersing an explosive cloud, possibly thermobaric in a path around the advance of the armored vehicle through the obstructions; and igniting the explosive cloud into the obstructions.

According to a fifth aspect of the present invention there is provided a method for interception of a swarm of autonomous vehicles, comprises dispersing an explosive cloud in an expected path of the swarm;

tracking swarm position to give a proximity of the swarm in relation to the explosive cloud; and when the incoming swarm is inside or within a predetermined proximity of the explosive cloud, igniting the explosive cloud to disrupt the swarm.

An embodiment may involve dispersing the explosive cloud from multiple canisters and igniting the cloud from each of the canisters in a predetermined order.

According to a further aspect of the present invention there is provided a method for interception of incoming ordnance, comprising:

dispersing at least one drone carrying material for forming a detonatable cloud to a location expected to intercept incoming ordnance;

in the event of detecting approach of incoming ordnance, expelling the material to form the detonatable cloud at a location in relationship to an expected path of the incoming ordnance, and igniting the detonatable cloud to disrupt the incoming ordnance; and in the event that no incoming ordnance is detected, retrieving the at least one drone.

According to a further aspect of the present invention there is provided a method for clearing an area around a perimeter, the method comprising:

dispersing a detonatable cloud in response to an incoming threat, the dispersal being to threaten an expected path of the incoming threat; and igniting the detonatable cloud into the incoming threat.

The method may involve detecting a direction of approach of a body and may categorize as a threat only those bodies moving in a given direction.

The perimeter may be mobile, say around an armored column on the move.

According to a yet further embodiment of the present invention there is provided a device for interception of incoming ordnance, comprising:

a detector configured to detect incoming ordnance and determine an expected path and timing of the incoming ordnance;

a first dispersion unit configured to disperse a cloud of detonatable material over a volume selected to affect the ordnance as the ordnance follows the expected path;

a first ignition unit configured to ignite the cloud of detonatable material, a second dispersion unit configured to disperse a second cloud of detonatable material into a partial vacuum created by detonation of the first cloud; and a second ignition unit configured to ignite the second cloud of detonatable material, thereby to disrupt the incoming ordnance.

According to a yet further embodiment of the present invention there is provided a device for interception of incoming ordnance, comprising:

a detector configured to detect incoming ordnance and determine an expected path and timing of the incoming ordnance;

a launcher configured to launch an explosive to intercept the expected path and explode;

a dispersion unit configured to disperse a cloud of detonatable material into a partial vacuum caused by the explosive;

an ignition unit configured to ignite the cloud of detonatable material to disrupt the incoming ordnance.

Unless otherwise defined, all technical and/or scientific terms used herein have the same meaning as commonly understood by one of ordinary skill in the art to which the invention pertains. Although methods and materials similar or equivalent to those described herein can be used in the practice or testing of embodiments of the invention, exemplary methods and/or materials are described below. In case of conflict, the patent specification, including definitions, will control. In addition, the materials, methods, and examples are illustrative only and are not intended to be necessarily limiting.

BRIEF DESCRIPTION OF THE SEVERAL VIEWS OF THE DRAWING(S)

Some embodiments of the invention are herein described, by way of example only, with reference to the accompanying drawings. With specific reference now to the drawings in detail, it is stressed that the particulars shown are by way of example and for purposes of illustrative discussion of embodiments of the invention. In this regard, the description taken with the drawings makes apparent to those skilled in the art how embodiments of the invention may be practiced.

Figure 16:
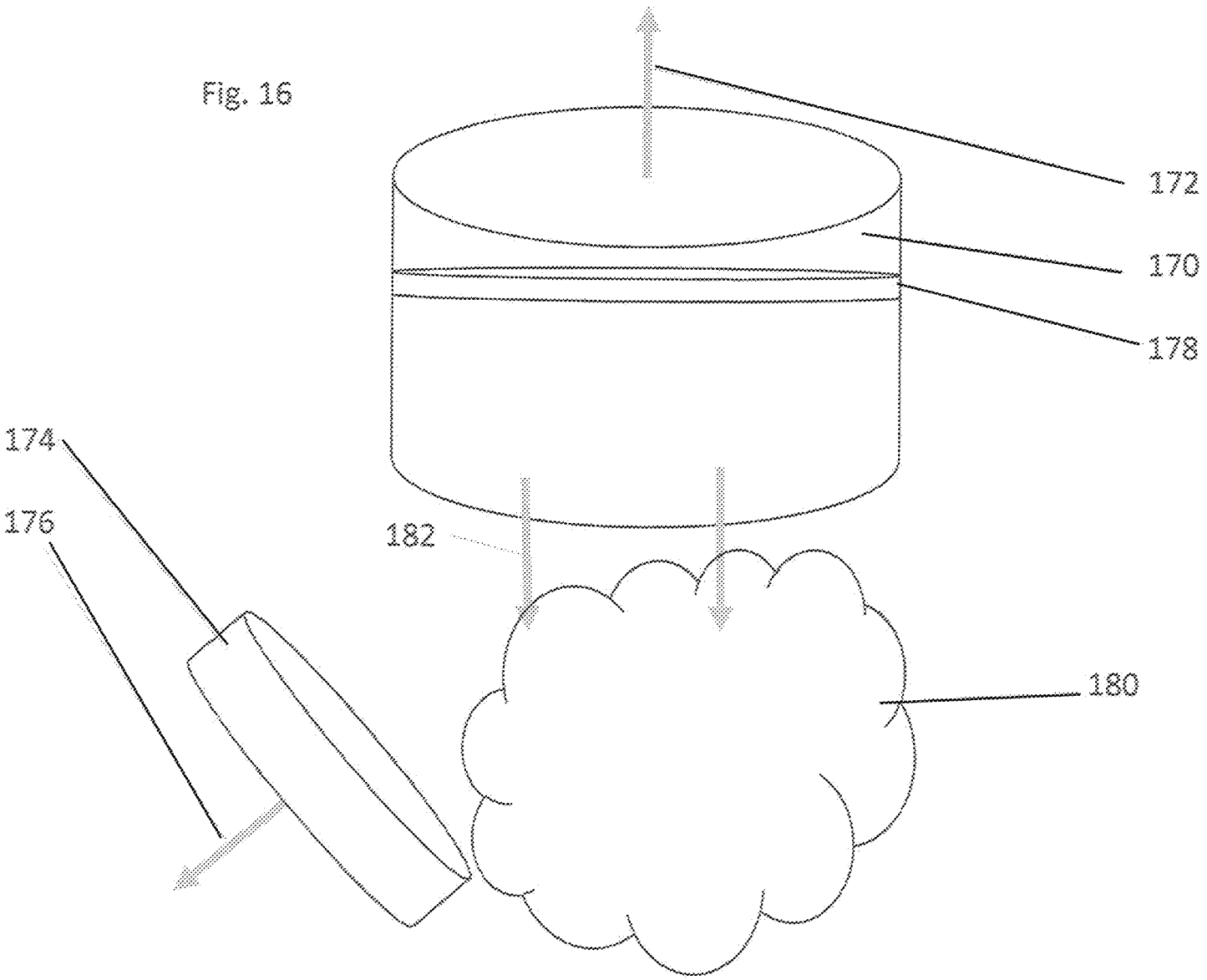
Figure 17:
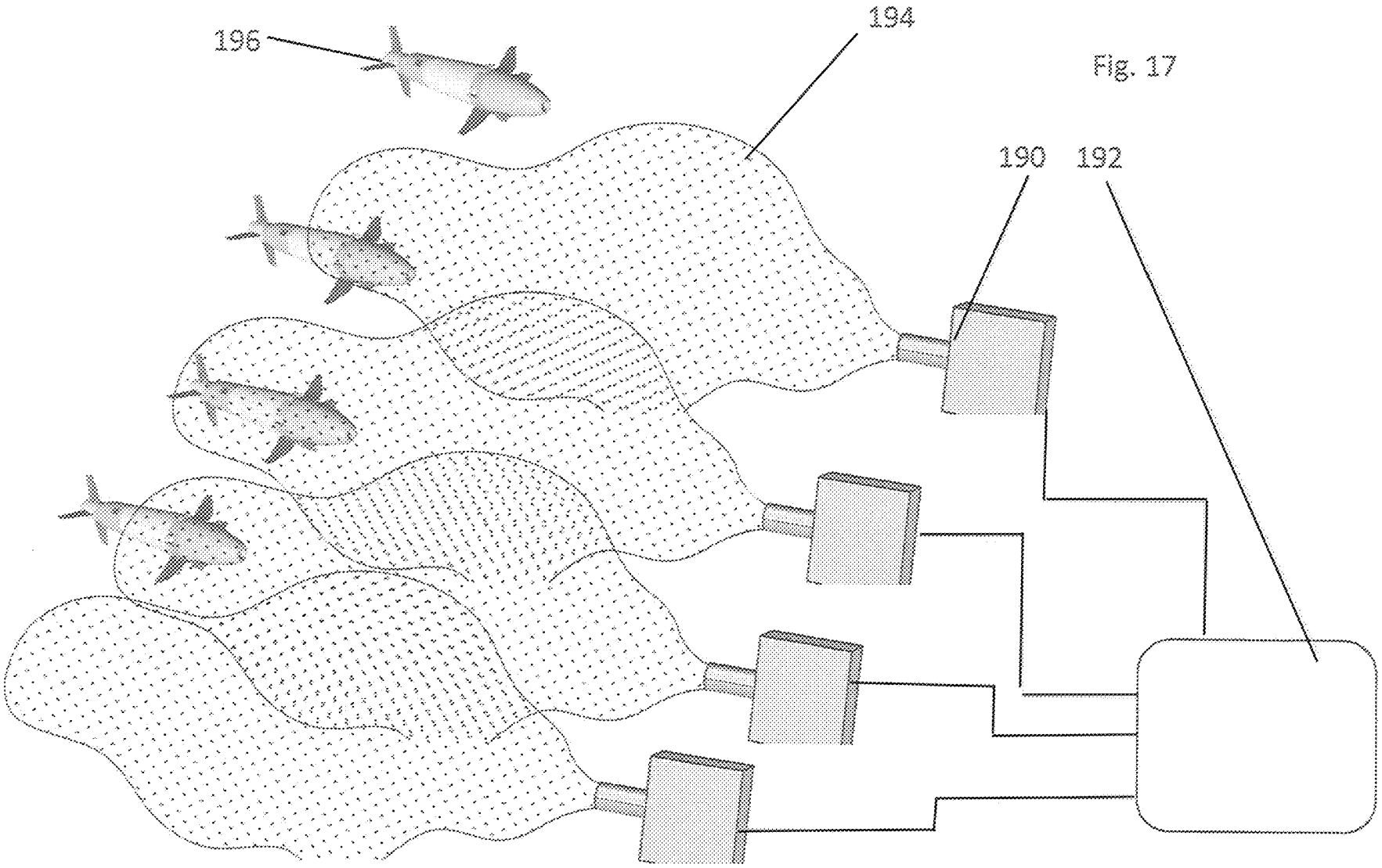
Figure 18:
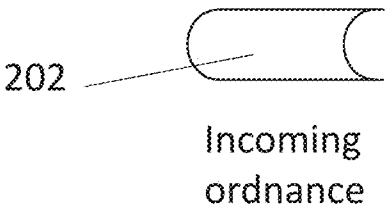
Figure 18:
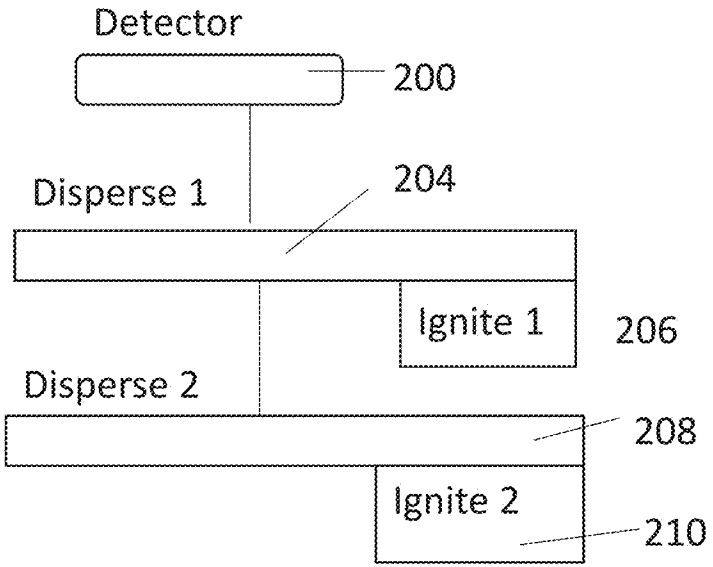
Figure 19:
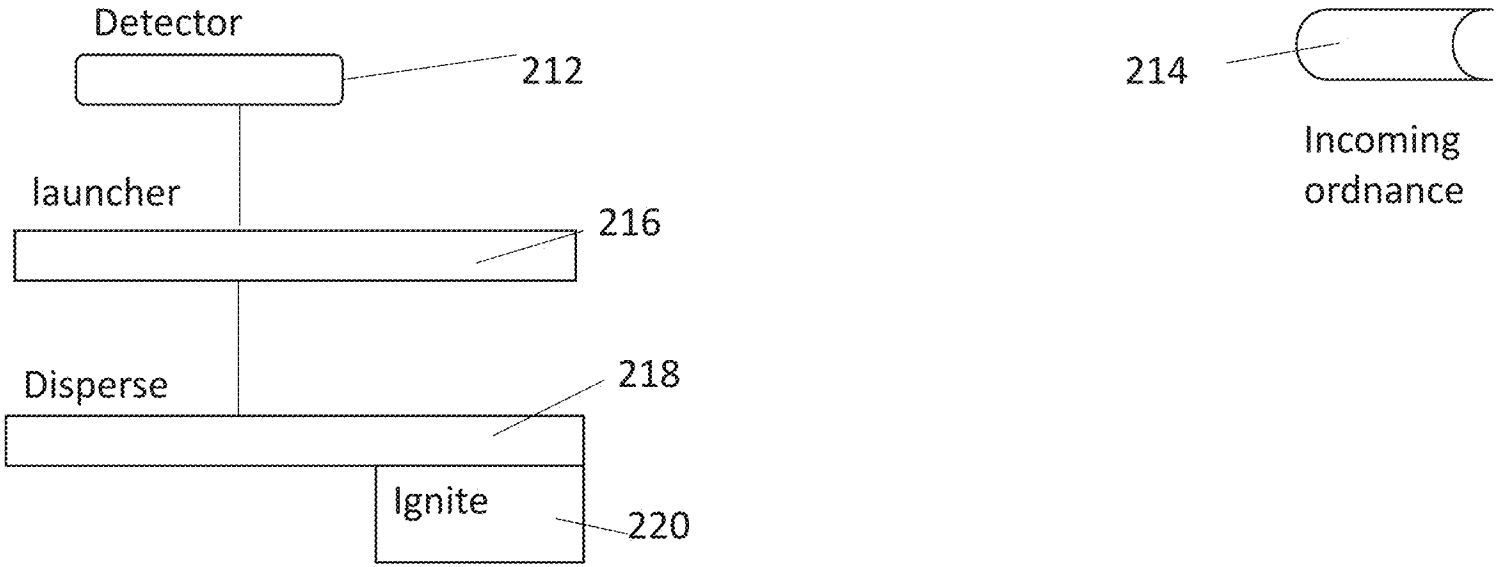

FIG. 16 schematically illustrates an embodiment of the present invention in which the back of a moving canister is opened and the contents exit to form a cloud behind the canister as it moves;

FIG. 17 illustrates a series of hoses, fed by a tank, which each spread a cloud along a perimeter;

FIG. 18 is a simplified diagram illustrating an embodiment in which a second cloud is injected into the partial vacuum formed by the first cloud according to embodiments of the present invention; and FIG. 19 is a simplified diagram illustrating a variation of the embodiment of FIG. 18 in which a conventional explosive is used in place of the first cloud.

DESCRIPTION OF SPECIFIC EMBODIMENTS OF THE INVENTION

The present invention, in some embodiments thereof, as explained above, relates to protection against incoming threats such as anti-tank ordnance, other missile threats and drones.

The embodiments provide a cloud of combustible liquid or powder or a combination thereof, such as for example air fuel, including aviation fuel and the like, and a method of delivery of the same, which is placed around or near to the expected path of the incoming ordnance. The cloud, and the time available for dispersion, defines a critical volume which may affect and defeat the ordnance, and the cloud is thus directed so that the critical volume includes the expected path. The cloud may be provided by a canister which is fired into the air in response to the incoming ordnance. Alternatively the cloud may be sprayed from a nozzle or the like to defend a perimeter. The cloud comprises droplets which mix with the surrounding air, which provides oxygen to enhance the resulting explosion as the cloud is detonated. Powdered aluminum may further enhance the explosion.

In a further alternative, a canister may be spring operated.

The system may separately contain energetic substance such as fuel, and oxidizer, the two being mixed as they are dispersed prior to ignition of the mixture.

Ignition may be a pyrotechnic device, or a device for producing a spark, say electronically controlled, or ignition may be chemically caused, say by a small amount of material that starts an exothermic reaction within the cloud.

The ignition device may be fired from the canister into the cloud. In particular the ignition device may be aimed at a specified part of the cloud so as to control the directions in which the explosion propagates through the cloud. Alternatively the ignition may occur at the canister during and typically towards the end of the dispersal sequence.

In embodiments the mixture may be sprayed from a hose, or from a vehicle, to defend a perimeter or border.

Before explaining at least one embodiment of the invention in detail, it is to be understood that the invention is not necessarily limited in its application to the details of construction and the arrangement of the components and/or methods set forth in the following description and/or illustrated in the drawings and/or the Examples. The invention is capable of other embodiments or of being practiced or carried out in various ways.

Figure 1:
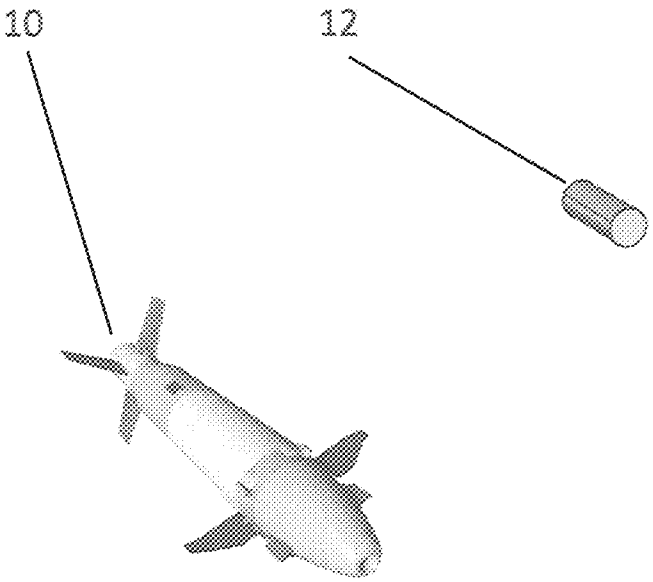
Fig. 1 Prior Art
FIG. 1 is a simplified schematic diagram of a known missile interception.

FIG. 1 illustrates the situation in the prior art wherein an incoming missile 10 is intercepted by canister 12. Incoming missile 10 maneuvers to avoid countermeasures and canister 12 must be sufficiently light and maneuverable to catch the incoming missile. The maneuverability requirement limits the amount of explosive that canister 12 may carry and hence means it has to get particularly close to the incoming missile 10, with a proximity level of around one metre being required.

Figure 2:
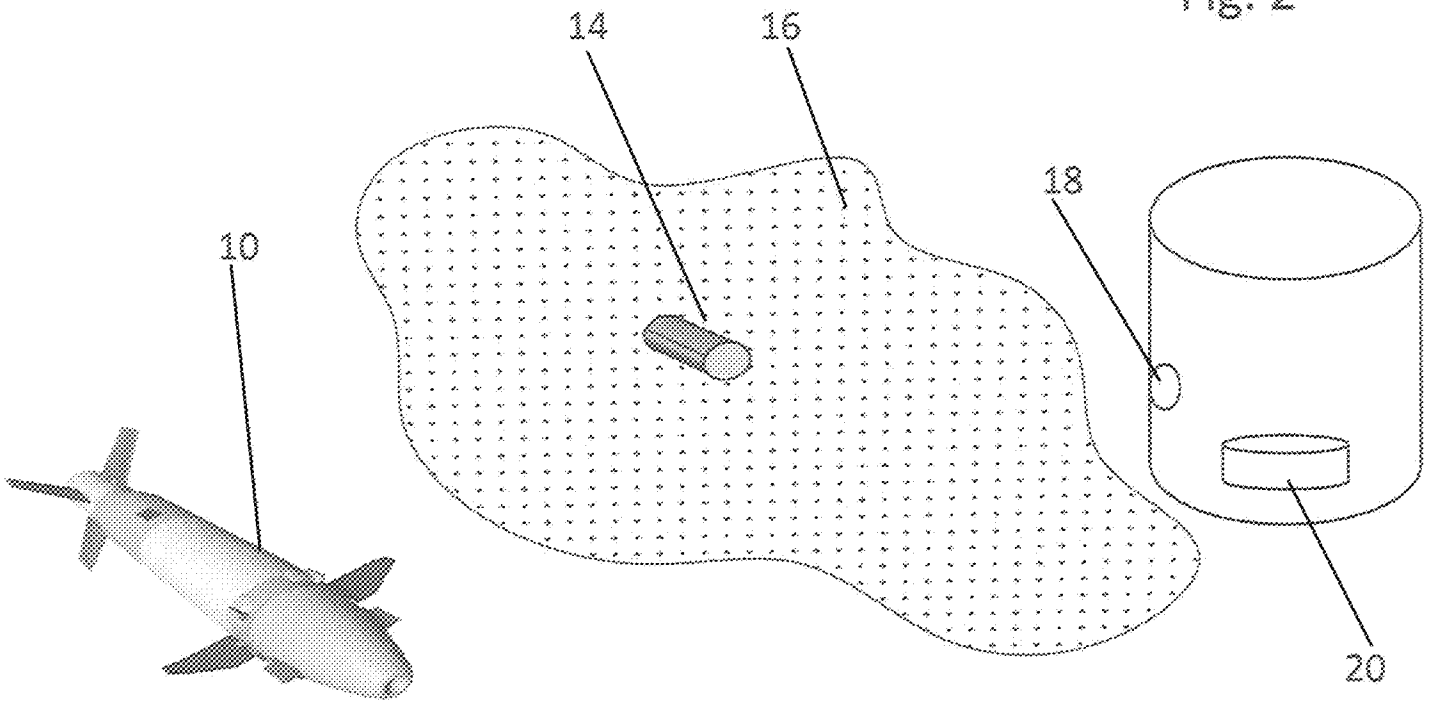
FIG. 2 is a simplified schematic diagram showing a missile interception according to the present embodiments.

Reference is now made to FIG. 2, which illustrates a canister 14 for interception of the incoming missile 10 according to embodiments of the present invention. The canister serves as a dispersion unit, which disperses an explosive cloud 16 in an expected path of the incoming ordnance 10. The dispersion unit need not be a canister but, as will be discussed in greater detail below, may be a hose or a spray gun, and may be mounted on a vehicle, including an airborne vehicle or a naval vehicle, or may be located at a fixed position on the ground. The cloud may include droplets or an aerosol of gasoline or high octane aviation fuel or the like. In addition solid explosive powder and/or additives may be used, such as aluminum powder.

The canister may include a proximity detector 18 that detects proximity of the incoming ordnance in relation to the explosive cloud 16. The proximity detector may be mounted on the device or remotely located, and may use radar or other RF systems, including electro-optical and laser sensing mechanisms and Lidar. An ignition unit 20 may be associated with the proximity detector, and may ignite the explosive cloud to disrupt the incoming ordnance when the incoming ordnance is in the cloud or has approached within a preset distance of the cloud. In embodiments the ignition always ignites the cloud after a certain delay following the dispersion, with the proximity unit being used to direct the dispersal of the cloud.

In embodiments, the proximity detector further predicts the expected path of the detected ordnance. In other embodiments the detector is not a proximity detector, but merely detects incoming ordnance and allows a path prediction, say based on ballistics. If the predicted path leads to an object that is to be protected, such as a tank, then a positive detection is indicated.

As shown here, the dispersion unit is a launchable canister, that may be launched against the incoming ordnance in any suitable manner, for example using rocket propulsion or a gun barrel.

Figure 3:
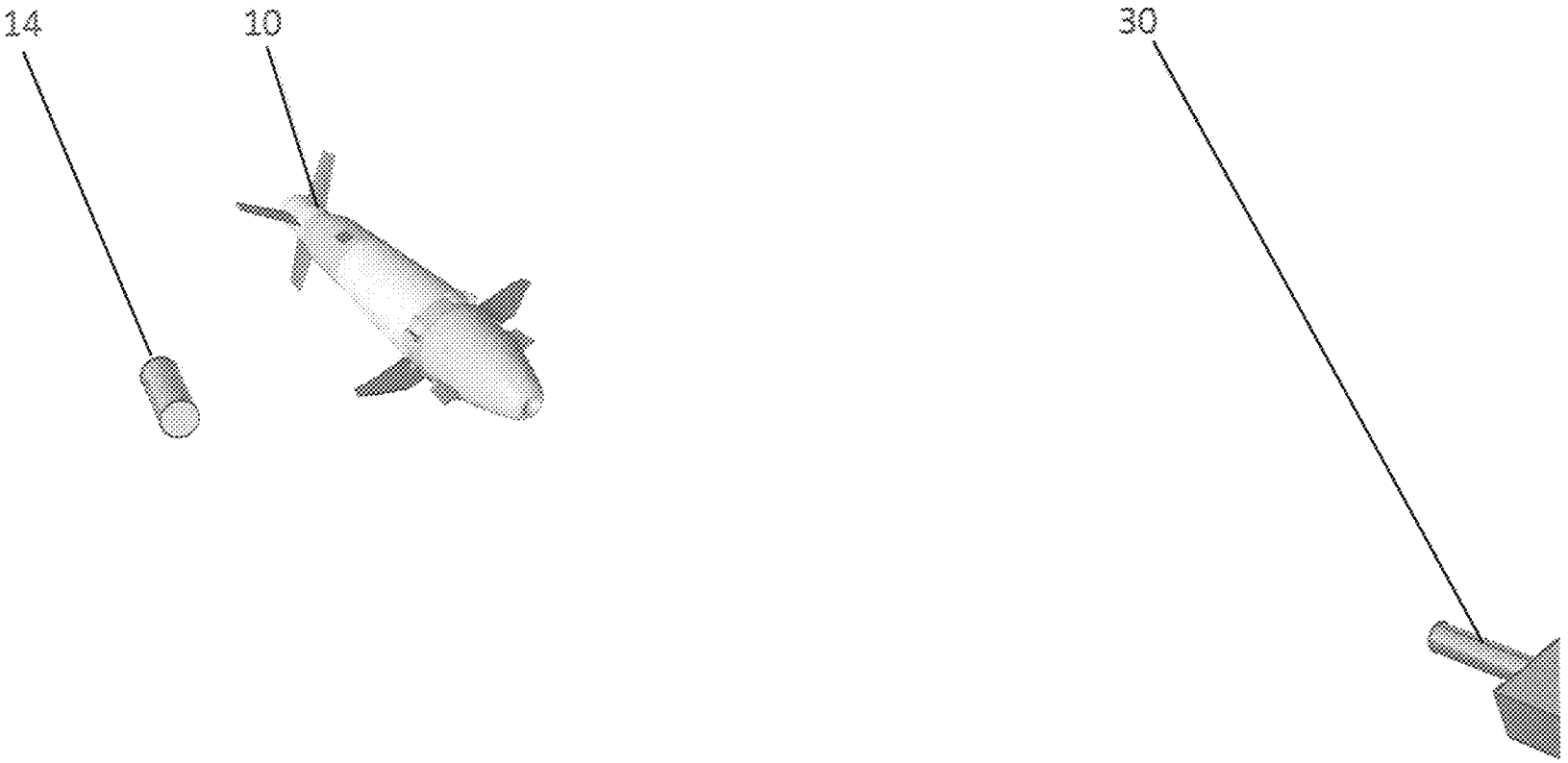
FIG. 3 is a simplified diagram showing the missile interception system of FIG. 2 in which a canister is launched from a gun.

The present embodiments may provide a cloud that is several tens of metres in size, depending on the size of the canister. The canister itself may be rocket propelled, or may be fired from a barrel 30, as shown in FIG. 3.

In an embodiment, two or more canisters may be fired, either to complement each other and provide a larger cloud, or so that the second provides a fallback position to the first, so that if the first fails to defeat the ordnance, the second has a chance to do so. In an embodiment it is possible to provide a sequence of canisters to form a corridor of detonating clouds, each exploding one after the other.

It is noted that the exploding cloud may disrupt one or more of radio frequency, optical—including laser—and infra-red guidance systems, and in particular if clouds are detonated in sequence then the incoming ordnance may be blinded for critical portions of its flight. In particular laser-guided ordnance may be disrupted both by disruption of the laser itself due to changing atmospheric conditions, and by the inability of the incoming ordnance to track the laser. Ordnance that looks for a thermal signature of its target may also be disrupted as the explosion interferes with the ability to track the thermal signature. Spray of the cloud material may continue until it is clear that the incoming ordnance has lost its lock on the target.

In an embodiment, the speed of the incoming ordnance may be detected, and accordingly an expected impact time with the target may be determined. Activation of the cloud material may then continue until the expected impact time.

In embodiments, the guidance system in use may be detected. For example the laser spot in a laser guidance system may be detected, and the sequence of explosions may be modified to cater for the guidance system detected.

The nozzle embodiment may likewise eject and detonate sequentially, taking into account the time it takes for the explosions to decay, and in addition to disrupting the ordnance, it may also serve to disrupt the detection systems as discussed above and blind the incoming ordnance. The nozzle may be at the end of a hose.

Furthermore, it may be possible to provide a mixture that promotes subsonic combustion, resulting in deflagration, which provides lengthy optical disablement. In the canister embodiment, the canister may thus include energetic material, oxidizer and deflagration agent.

Embodiments in general may use the thermobaric effect, which exhausts oxygen in the cloud to efficiently enable the explosion.

In a further embodiment, a thermobaric explosion according to the present embodiments may be used to control or extinguish another fire since the cloud sucks oxygen from the atmosphere. In a variation, fire extinguishing materials may be added to the cloud, so that for example an oil fire is effectively deprived of oxygen.

Figure 4:
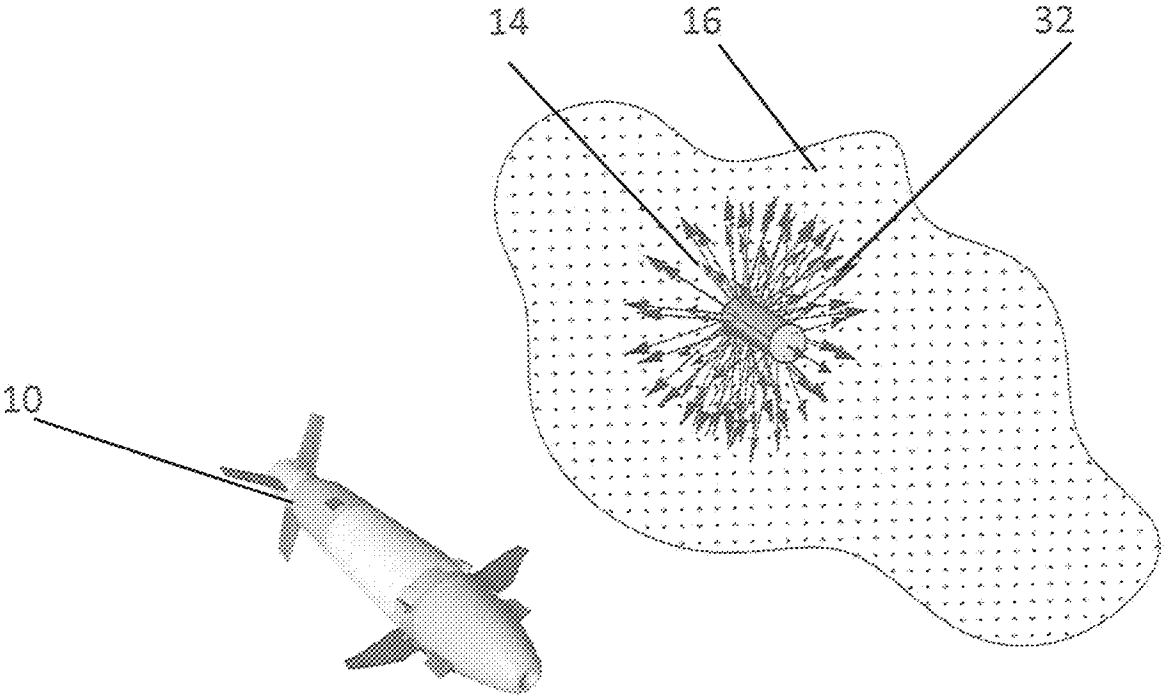
FIG. 4 is a simplified diagram showing detonation of an explosive cloud according to the present embodiments.
Figure 5:
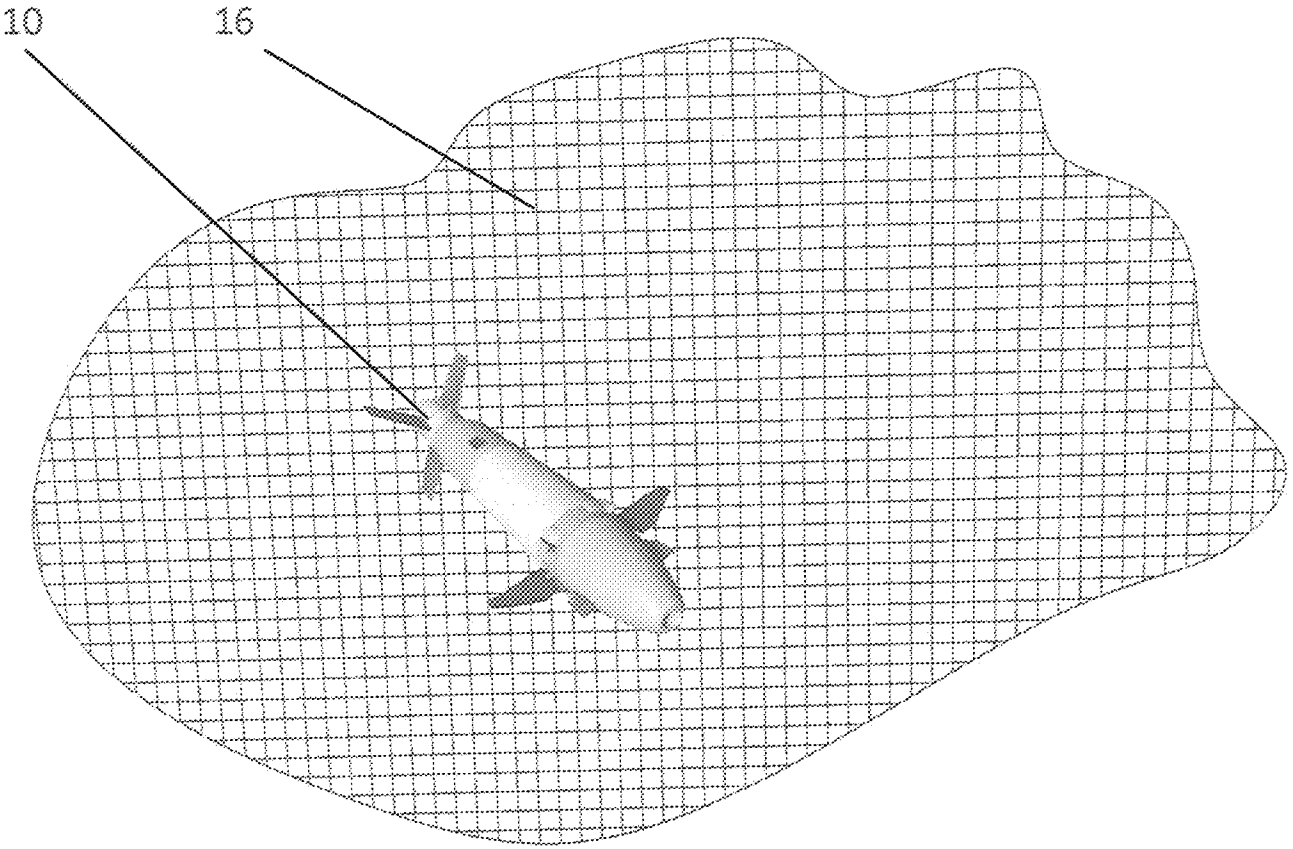
FIG. 5 is a simplified diagram showing a missile flying into an explosive cloud according to the present embodiments.
Figure 6:
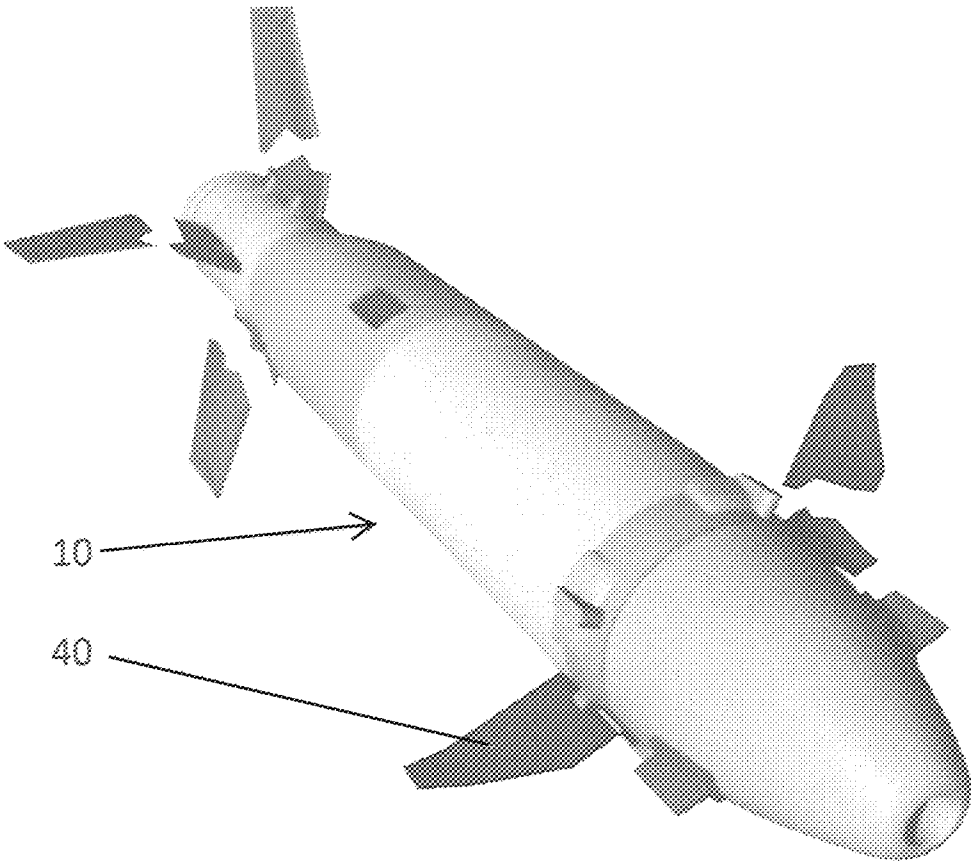
FIG. 6 is a simplified diagram showing damage caused to an incoming missile due to operation of the present embodiments.

FIG. 4 illustrates the detonation 32 provided by the detonation unit in the canister into the cloud 16, which ignites the cloud to damage or deflect the missile 10. FIG. 5 illustrates the missile 10 having entered the cloud, at which point the cloud is to be detonated. The detonation of the cloud may give rise to pressures which are several tens of atmospheres, considerably lower than the pressures caused by high explosive, but much more spread out. FIG. 6 illustrates how such an explosion may break off some of the fins 40 of missile 10.

Figure 7:
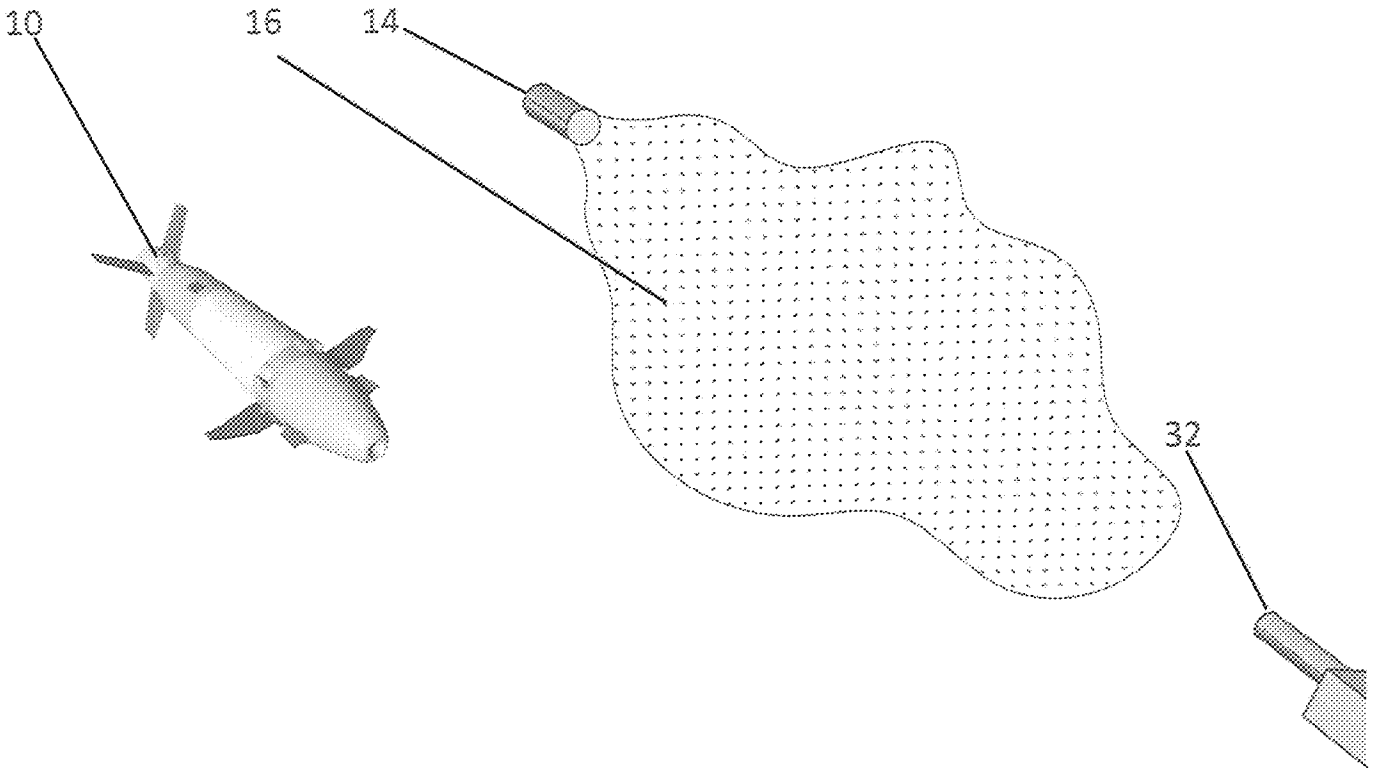
FIG. 7 is a simplified diagram showing a barrel-launched canister, according to an embodiment of the present invention.

FIG. 7 illustrates incoming missile 10 against which canister 14 has been fired from barrel 30. The canister releases cloud 16 which is subsequently detonated as the missile approaches the cloud.

In some cases the cloud may be too distant from the canister to be ignited from the canister. Accordingly the detonation or ignition unit may be launched into the cloud.

It is to be noted that the canister may include both energetic explosive material and oxidizer, which may be held in separate cans and/or mixed together prior to ignition. The system of the present invention may thus be used in locations where the natural oxygen level is very low. Thus at sea level oxygen consists of 20% of the atmosphere, but say 5 to 10 km above the earth's surface, there may not be sufficient oxygen naturally present to support the desired explosion. The present embodiments may thus provide the oxidizer to overcome the lack of naturally present oxygen.

A further embodiment of the present invention is directed to the defeat of hypersonic missiles which follow a path through upper levels of the atmosphere. At these heights the atmosphere is relatively passive so that a cloud is stable for relatively long periods of time. A cloud of energetic material with or without oxidizer, is thus placed in the path of the incoming hypersonic missile. The missile may itself ignite the cloud, for example as a result of its engine, typically a ramjet engine.

Furthermore, the contents of the cloud may be inhaled by the jet or ramjet engine and explode within, thereby disrupting integrity of the threat.

Similar clouds may be used against aircraft, cruise missiles and drones, and oxidizer may be used or not used as necessary, depending on the altitude involved. Again the engine of the target may provide the combustion.

Likewise anti-tank ordnance often has a rocket motor which may ignite the cloud and accordingly a separate ignition unit may be dispensed with.

It is further noted that one of the means with which the cloud may defeat a target is that the cloud depletes the oxygen in the vicinity of the target and thus interferes with, for example disables or extinguishes, the motor.

In a further embodiment, the cloud may comprise only or mainly oxidizer, which may likewise interfere with the motor.

Figure 8A:
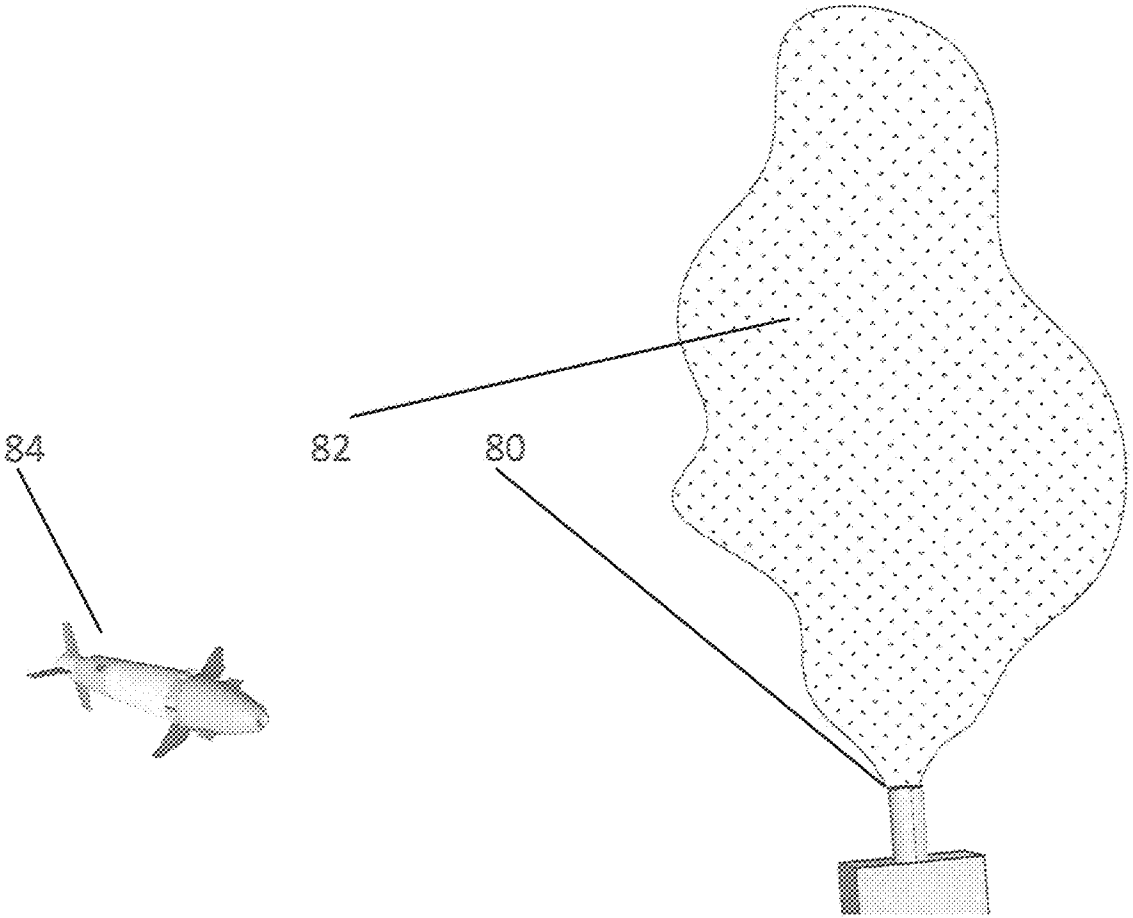
FIGS. 8A, 8B and 9, are two simplified diagrams showing a cloud launched from a hose and detonated, according to a further embodiment of the present invention.
Figure 8B:
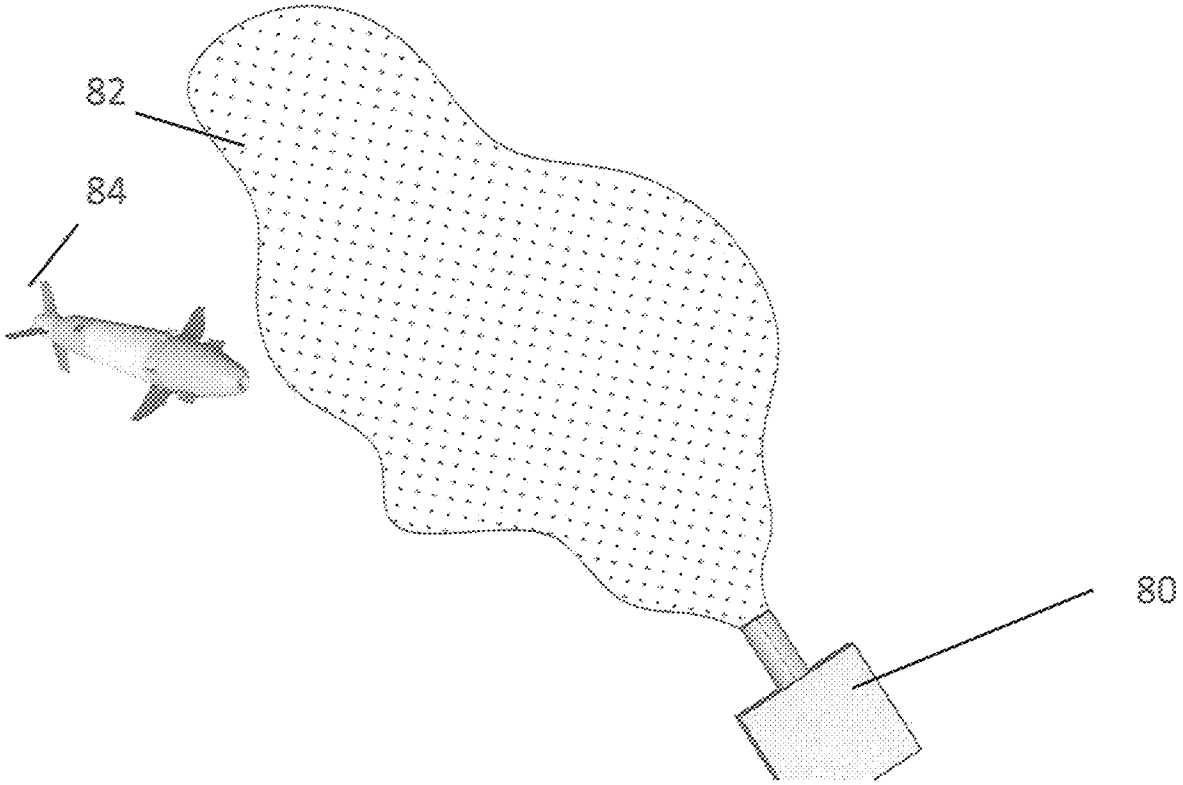

Reference is now made to FIGS. 8A and 8B, which show an alternative embodiment of the present invention, in which the dispersion unit is the nozzle of a hose 80. The hose disperses a cloud 82 in the path of incoming missile 84 when for example an asset or border is being threatened. As shown in FIG. 8B, the angle of the nozzle may be altered in order to direct the cloud in a particular direction.

Figure 9:
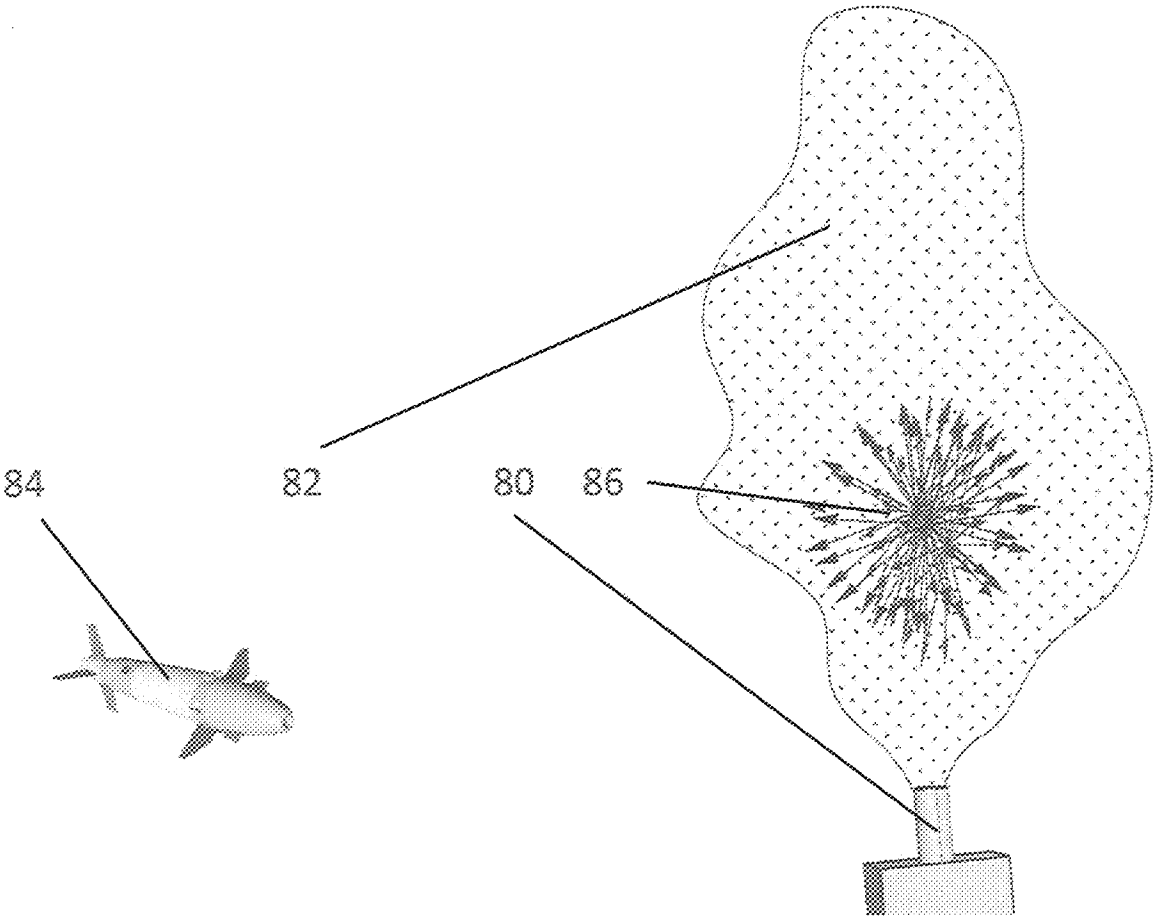

As shown in FIG. 9, the nozzle then provides a spark 86 to detonate the cloud as the missile enters. The hose may be carried on a vehicle. The nozzle may be directed so as to locate the cloud more exactly. In an embodiment, the hose may be held at a predetermined height, above or away from the vehicle. The hose may be rigid, or held on a pole, including a telescopic pole so as to be extendible and retractable as required. Thus the cloud is kept away from the vehicle or other body that is being defended. The hose etc may be directed towards the incoming threat.

In some cases the cloud may be too distant from the nozzle to be ignited from the nozzle. Accordingly the detonation or ignition unit may be launched into the cloud.

Figure 10:
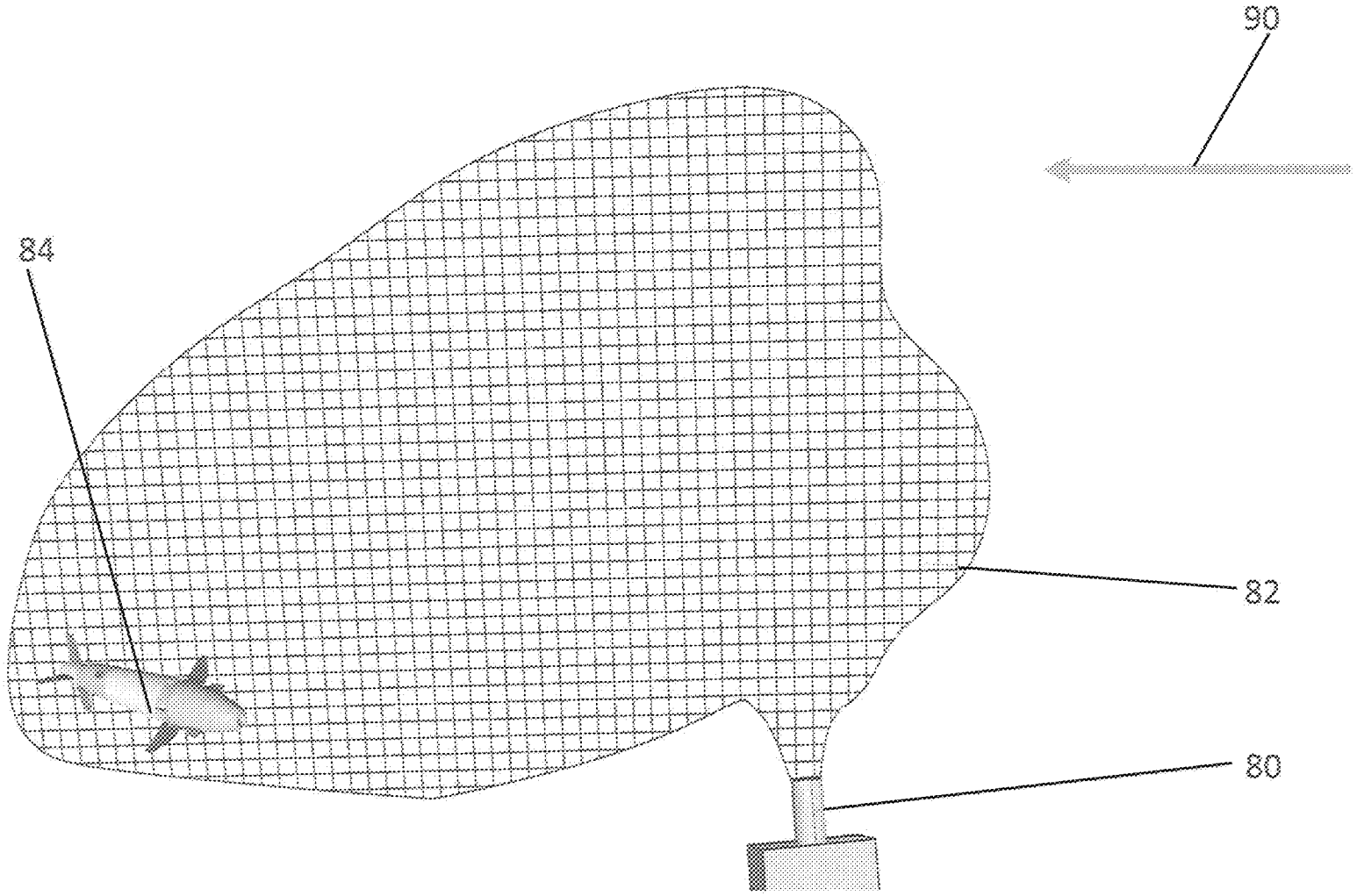
FIG. 10 is a simplified diagram showing effects of wind for cloud dispersal according to embodiments of the present invention.

As shown in FIG. 10, the formation of the cloud may be affected by weather conditions, such as wind speed and direction, humidity, etc. Thus a strong wind in the direction of arrow 100 may cause cloud 82 dispersed by hose 80 to veer strongly with the wind. The wind direction may be taken into account, so as to direct the nozzle appropriately, so that the cloud stands in the path of missile 84. It is to be noted that consideration of the wind to direct formation of the cloud applies to all of the embodiments herein. In particular, the same applies mutatis mutandis to the canister embodiment referred to hereinabove.

Figure 11:
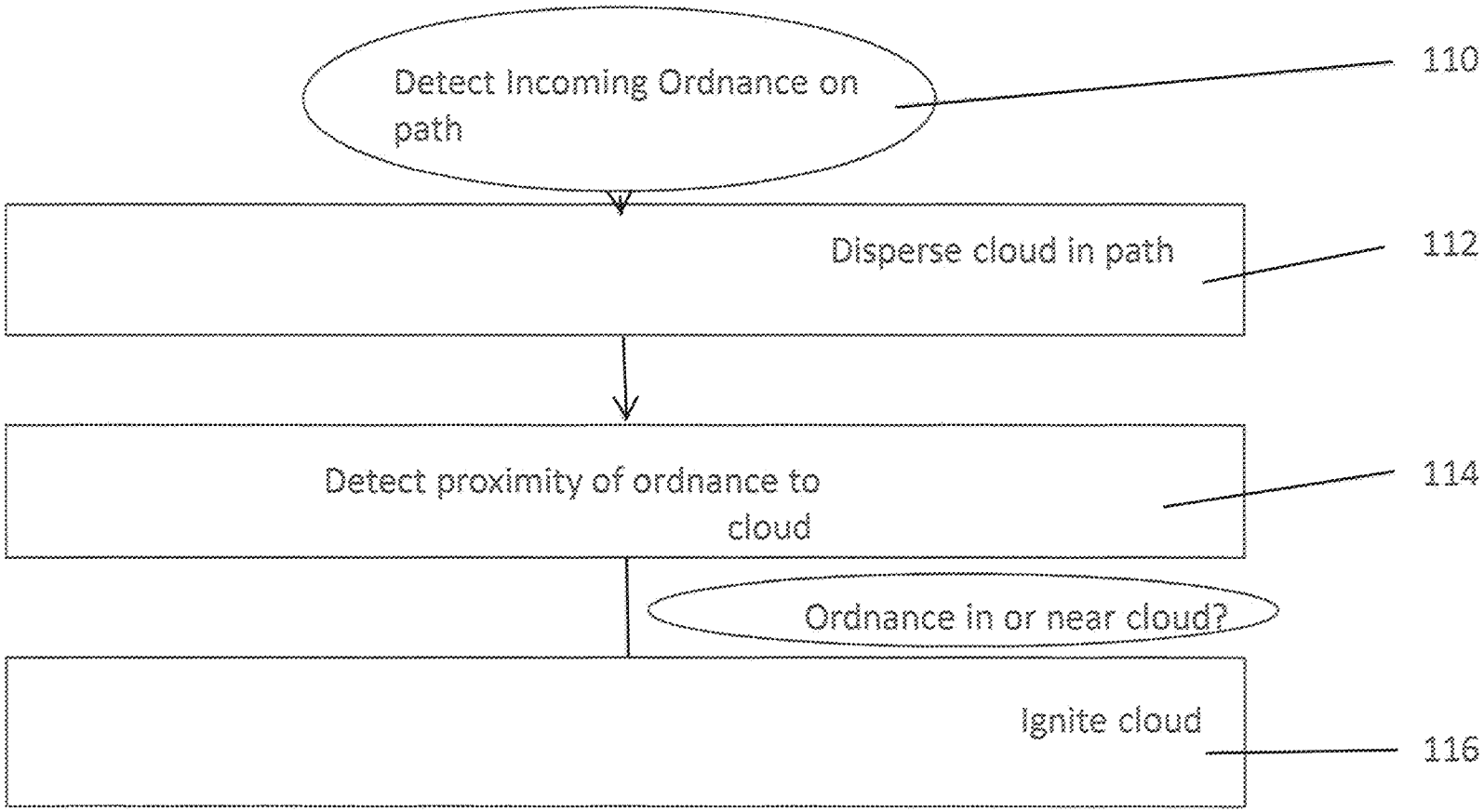
FIG. 11 is a simplified flow diagram showing operation of the device of FIGS. 1-10.

Reference is now made to FIG. 11, which is a simplified flow chart showing a method for interception of incoming ordnance—110. The method comprises dispersing an explosive cloud into an expected path of the incoming ordnance—112. Then proximity of the incoming ordnance in relation to the explosive cloud is determined—114. Then, when the incoming ordnance is within a predetermined proximity of the explosive cloud, the explosive cloud may be ignited to disrupt the incoming ordnance 116. As discussed above, the method may include detecting a wind speed and direction and using the wind speed and direction to modify the predetermined proximity. Thus, as shown in FIG. 10, if the cloud is dispersed to the wind in one particular direction, then proximity may be recalculated on the basis of the way in which the cloud disperses due to the wind. Likewise the cloud itself may be released from a modified location so that the missile path is intercepted based on the wind dispersion.

The blast may be intended to take advantage of a drop in pressure, the partial vacuum, around the area of the blast which occurs as the fuel uses up oxygen. This may be in addition to or instead of the blast wave itself, as both effects are able to disrupt an object in flight.

In an embodiment, a further cloud of droplets is provided in the partial vacuum and detonated to meet the returning air, which returning air temporarily creates a positive pressure, thus causing a second explosion into an excess of oxygen. That is to say, two clouds of droplets are dispersed. The first is detonated and the second is dispersed into the partial vacuum. As the air returns to the area of the partial vacuum the second cloud is detonated into the overpressure.

In an embodiment, the first explosion may be a conventional explosion and the cloud is then dispersed into the resulting partial vacuum and ignited.

Figure 12:
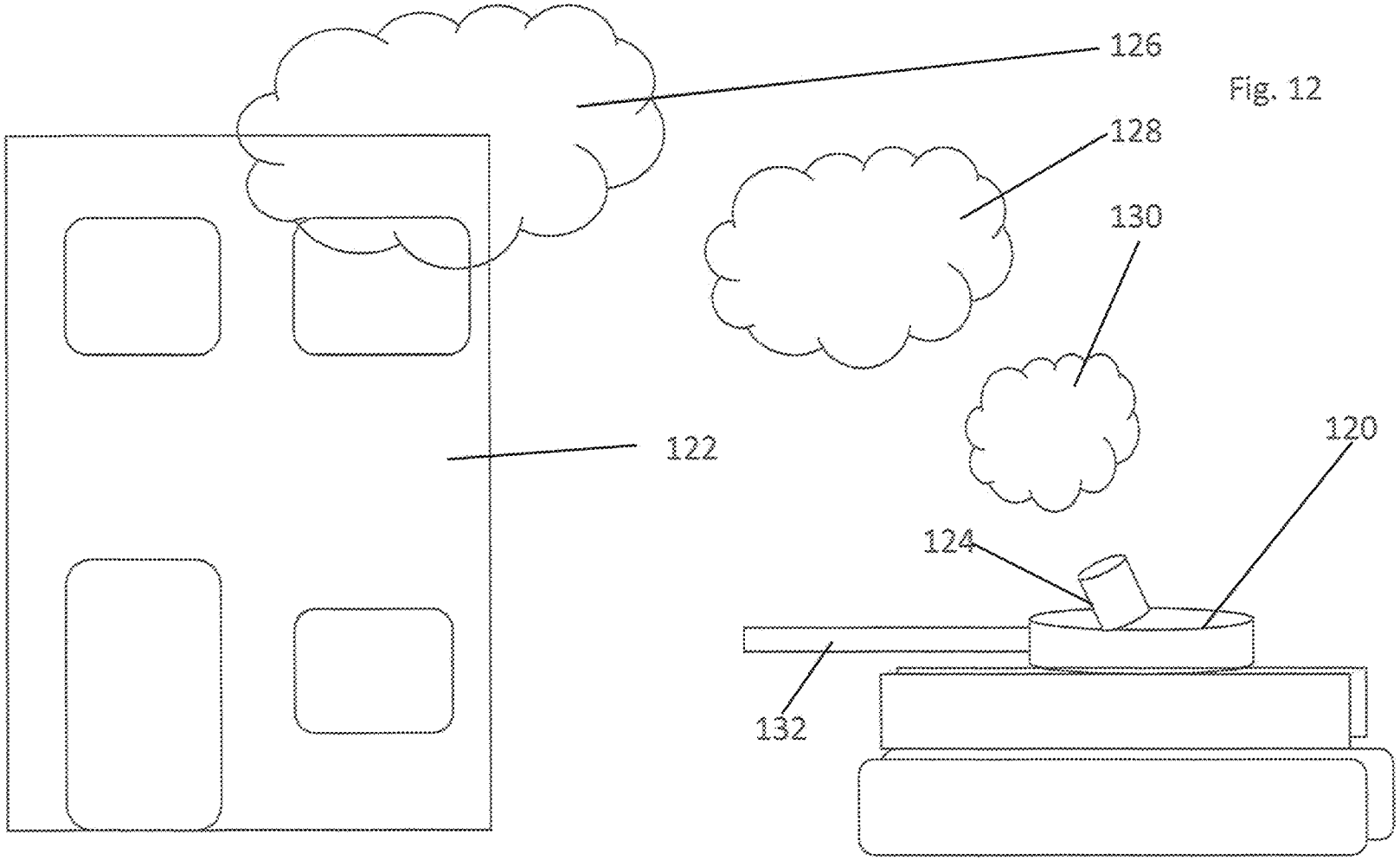
FIG. 12 is a simplified diagram showing a further embodiment of the present invention in which a cloud is launched from a vehicle and used to clear obstacles of hidden threats.

Reference is now made to FIG. 12, which is a simplified diagram showing an armored vehicle 120 advancing through obstructions such as building 122. The obstructions obscure line of sight from the armoured vehicle, allowing snipers, RPG—rocket propelled grenade—operators and the like to threaten the armoured vehicle.

The armoured vehicle thus includes dispersion unit 124 to disperse an explosive cloud 126, 128, 130 around the armoured vehicle. An ignition unit is associated with the armoured vehicle and may ignite the explosive cloud to explode into the obstructions. The explosion may leave armor unaffected but may neutralize threats hiding in or behind the obstacle. In embodiments the cloud may be dispersed from a canister launched through the vehicle's main gun 132. The same may be used for approaching enemy forces trying to use blindspots to get close to the armoured vehicle. The dispersion unit may have a mode in which it is operated automatically as an approach or unexpected movement is detected. In a variation of this mode, the system may be placed on the ground or on a vehicle requiring protection or on a specialized vehicle carrying the system, and may automatically disperse and activate a cloud on detection of any movement from a given direction, or based on any other desired parameter. Using the present embodiments, the size of the resulting explosion may be controlled precisely by spraying a requisite amount of material. Thus the system may be set to provide warnings, mild injury or fatalities as required. The system may use input from sensors in order to carry out such control.

In some cases, the obstacles may be tunnels. The explosive cloud may be aimed into the mouth of the tunnel. If necessary, oxidizing agent may be added to the mixture to ensure the necessary burn in the tunnel.

An embodiment may prevent approach within a given perimeter, whether a static or moving perimeter. As soon as anything or anyone unauthorized is detected approaching the perimeter a cloud is launched and ignited. On the other hand movement outwardly from the perimeter may be allowed, so for example outgoing ordnance is allowed to proceed unchallenged while incoming ordnance is stopped. The system may also be operated by friend or foe identification.

Figure 13:
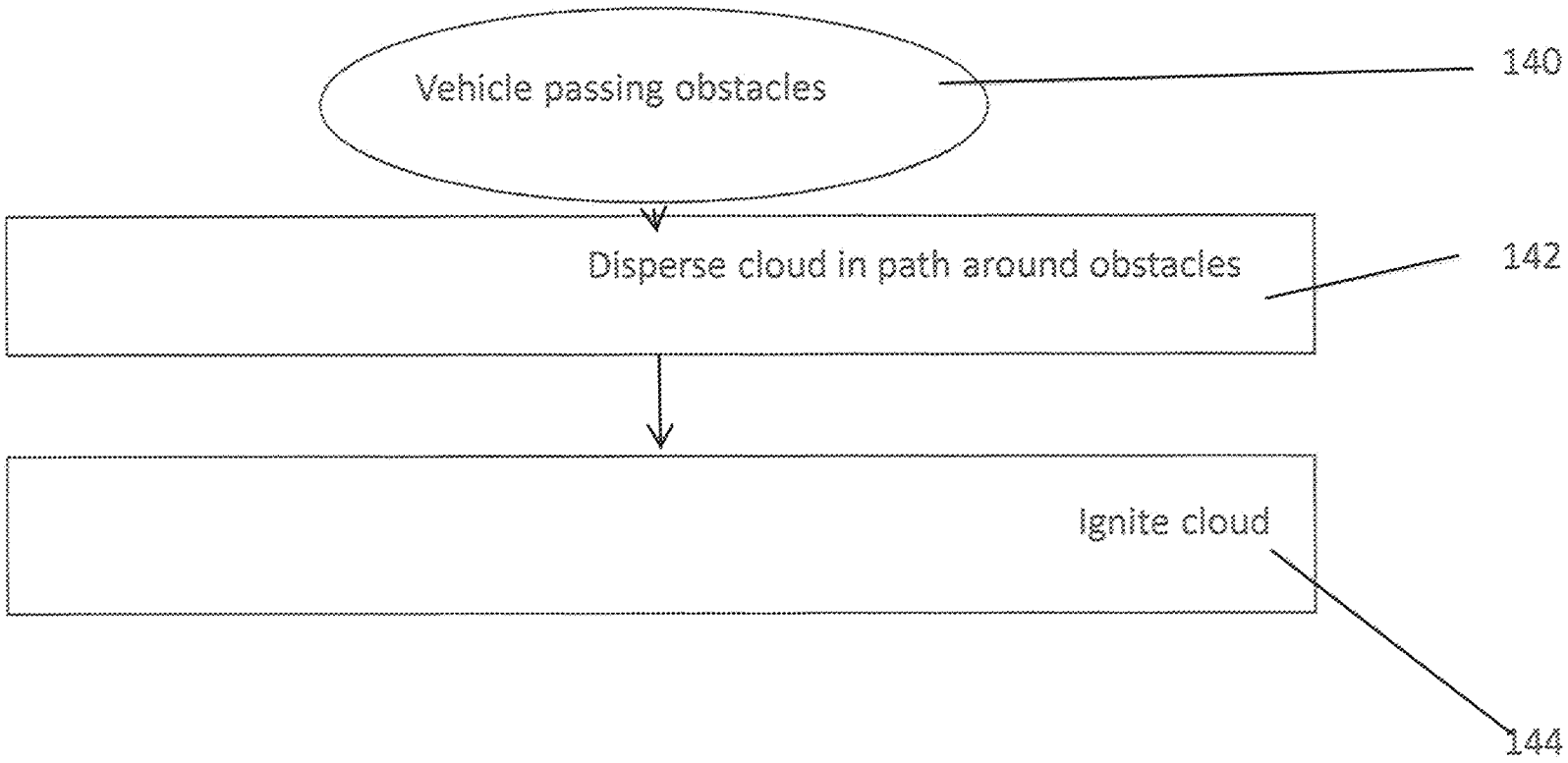
FIG. 13 is a simplified flow diagram showing operation of the embodiment of FIG. 12.

Referring to FIG. 13, there is shown a flow chart illustrating a method 140 for clearing an area around an armored vehicle advancing through obstructions, the obstructions obscuring line of sight from the armored vehicle. The method comprises dispersing an explosive cloud in a path around the advance of the armored vehicle through the obstructions—142, and igniting the explosive cloud into the obstructions—144.

Figure 14:
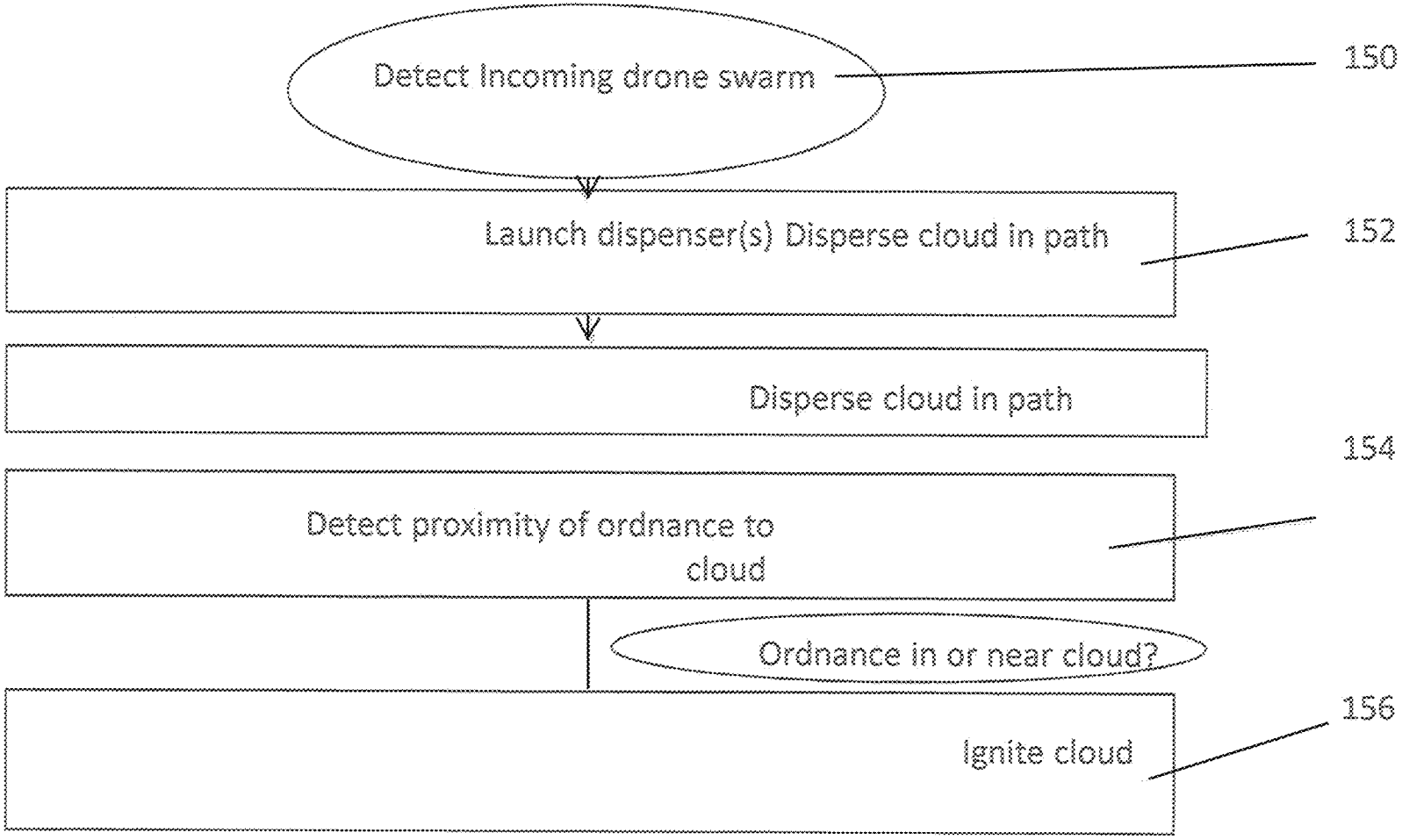
FIG. 14 is a simplified flow diagram showing a method of dispersal of an explosive cloud according to the present embodiments for countering a swarm of autonomous vehicles, particularly of autonomous flying vehicles.

Reference is now made to FIG. 14, which is a simplified diagram showing a method 150 for interception of a swarm of autonomous vehicles. The method comprises dispersing an explosive cloud in an expected path of the swarm—154. The dispersal may be via a nozzle, say from a hose mounted on a vehicle, or from canisters launched towards the swarm—152, as with the previous embodiments.

The swarm position may be detected and tracked, to give a proximity of the swarm in relation to the explosive cloud, and when the incoming swarm is inside or within a predetermined proximity of the explosive cloud, the method may involve igniting the explosive cloud to disrupt the swarm. In embodiments, the cloud may be dispersed from multiple canisters and ignition from each of said canisters may be provided in a predetermined order.

In all of the cases discussed herein, proximity detection may be carried out using a sensor on a canister, or a sensor on a vehicle, or a sensor on a ground-based installation or a sensor on a central control station.

Figure 15:
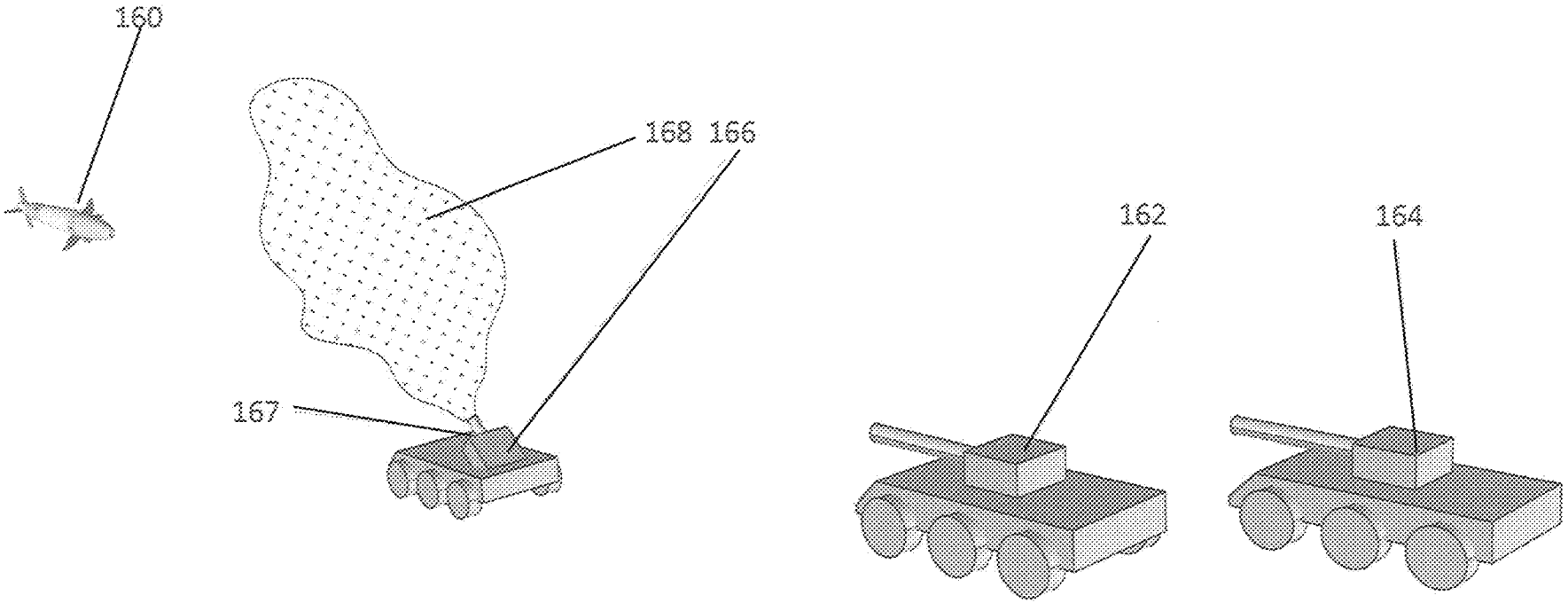
FIG. 15 is a simplified diagram showing how an explosive cloud may be dispersed from one vehicle in order to protect other vehicles from an incoming missile according to embodiments of the present invention.

FIG. 15 is a simplified diagram showing how an explosive cloud may be dispersed from one vehicle in order to protect other vehicles from an incoming missile according to embodiments of the present invention. Incoming missile 160 threatens vehicles 162 and 164. Protective vehicle 166 uses the nozzle, say of a hose 167, to throw up explosive cloud 168 between the incoming threat and the vehicles to be protected, which cloud may be detonated as the missile enters or gets close to the cloud. It will be appreciated that the protective vehicle 166 may alternatively launch canisters.

FIG. 16 schematically illustrates an embodiment of the present invention in which the back of a moving canister is opened and the contents exit to form a cloud behind the canister as it moves. Canister 170 is flying through the air in the direction of arrow 172. As the canister passes an intended extremity of the cloud, the back 174 is removed in the direction of arrow 176. Membrane 178 is propelled downwards by a pressurized propellant gas and pushes explosive material out of the canister to form cloud 180 in the direction of arrow 182. The cloud may be expelled through an aerosol mechanism. In embodiments, the membrane may be dispensed with so that the explosive material merely diffuses from the canister. The explosive cloud is subsequently detonated.

FIG. 17 illustrates a series of hoses 190, fed by a tank 192, which each spread a cloud 194 from a nozzle along a perimeter as incoming missiles 196 approach. Again, as the missiles approach the cloud is detonated in the path of the missile. The hoses may be mounted on mobile vehicles, and the vehicles may be able to move as far as the connection to the tank allows. In embodiments, each vehicle may have its own reserve tank, so that the vehicles may be able to detach from the main tank as necessary and reach new positions which the connection does not allow.

Reference is now made to FIG. 18, which illustrates a device for interception of incoming ordnance according to the present embodiments. The device includes a detector 200 to detect incoming ordnance 202 and determine an expected path and timing of the incoming ordnance. A first dispersion unit 204 disperses a cloud of detonatable material over a volume selected to affect the ordnance as the ordnance follows the expected path.

A first ignition unit 206 may ignite the cloud of detonatable material, causing an explosion along the expected path and a partial vacuum due to the explosion. A second dispersion unit 208 then disperses a second cloud of detonatable material into the partial vacuum created by detonation of the first cloud. A second ignition unit 210 then ignites the second cloud of detonatable material, and further disrupts the incoming ordnance.

FIG. 19 illustrates an alternative device for interception of incoming ordnance, which comprises a detector 212 which detects incoming ordnance 214 and determines the expected path and timing of the incoming ordnance as above. A launcher 216 may launch an explosive, say contained in a projectile, to intercept the expected path and explode.

A dispersion unit 218 may disperse a cloud of detonatable material into a partial vacuum caused by the explosive, and an ignition unit 220 ignites the cloud of detonatable material to disrupt the incoming ordnance.

In embodiments the dispersion unit may be a drone. The drone may be prepositioned at a strategic location prior to the detection of the incoming ordnance, so as to be able to intercept the incoming ordnance in good time. The drone may then be returned to base for reuse if not needed.

2A further embodiment is intended for swarms of drones. The drones may be highly maneuverable and very fast and the swarm may be spread over a wide area making it hard to predict how an attack will develop. In the embodiment, a series of canisters are launched adjacent the predicted path of the swarm and allowed to descend by parachute. Alternatively the canisters may be part of a drone and float at the predicted area. Several canisters may thus form a midair minefield and can be activated either via a remote command or via their own sensors, or via remote drone detection systems, as known in the art.

The terms "comprises", "comprising", "includes", "including", "having" and their conjugates mean "including but not limited to".

The term "consisting of" means "including and limited to".

The term "consisting essentially of" means that the composition, method or structure may include additional ingredients, steps and/or parts, but only if the additional ingredients, steps and/or parts do not materially alter the basic and novel characteristics of the claimed composition, method or structure.

As used herein, the singular form "a", "an" and "the" include plural references unless the context clearly dictates otherwise.

It is appreciated that certain features of the invention, which are, for clarity, described in the context of separate embodiments, may also be provided in combination in a single embodiment and the present description is to be construed as if such embodiments are explicitly set forth herein. Conversely, various features of the invention, which are, for brevity, described in the context of a single embodiment, may also be provided separately or in any suitable subcombination or may be suitable as a modification for any other described embodiment of the invention and the present description is to be construed as if such separate embodiments, subcombinations and modified embodiments are explicitly set forth herein. Certain features described in the context of various embodiments are not to be considered essential features of those embodiments, unless the embodiment is inoperative without those elements.

Although the invention has been described in conjunction with specific embodiments thereof, it is evident that many alternatives, modifications and variations will be apparent to those skilled in the art. Accordingly, it is intended to embrace all such alternatives, modifications and variations that fall within the spirit and broad scope of the appended claims.

It is the intent of the applicant(s) that all publications, patents and patent applications referred to in this specification are to be incorporated in their entirety by reference into the specification, as if each individual publication, patent or patent application was specifically and individually noted when referenced that it is to be incorporated herein by reference. In addition, citation or identification of any reference in this application shall not be construed as an admission that such reference is available as prior art to the present invention. To the extent that section headings are used, they should not be construed as necessarily limiting. In addition, any priority document(s) of this application is/are hereby incorporated herein by reference in its/their entirety.

What is claimed is:

1. Device for disruption of incoming ordnance, comprising:

a first detector configured to detect incoming ordnance and determine an expected path and timing of said incoming ordnance;

an undetonated cloud dispersion unit configured to disperse a cloud of undetonated material over a volume selected to affect said ordnance as said ordnance follows said expected path, said material being detonatable;

an ignition unit configured to ignite said cloud of undetonated material at a time at which said incoming ordnance is susceptible to be disrupted by an explosion in said volume, thereby to disrupt the incoming ordnance; and a second detector for detecting wind speed or wind direction or temperature, or humidity, or barometric pressure, and modifying a manner in which said undetonated material is dispersed to form a cloud, said modified dispersing being prior to igniting.

2. The device of claim 1, wherein said undetonated cloud dispersion unit is a launchable canister.

3. The device of claim 2, wherein the launchable canister is rocket propelled.

4. The device of claim 2, wherein the launchable canister is configured for firing from a barrel.

5. The device of claim 1, wherein said undetonated cloud dispersion unit is a nozzle, or the nozzle of a hose, or a hose.

6. The device of claim 1, wherein said undetonated cloud dispersion unit is carried on a vehicle.

7. The device of claim 1, wherein said undetonated cloud dispersion unit is a drone.

8. The device of claim 1, where the undetonated cloud comprises an oxidizer.

9. The device of claim 1, wherein said undetonated cloud comprises one member of the group comprising detonatable powder and liquid.

10. The device of claim 1, wherein the detector is remotely located from the undetonated cloud dispersion unit.

11. The device of claim 1, wherein the detector comprises a proximity detector, which proximity detector is configured to detect that said incoming ordnance is approaching.

12. The device of claim 1, wherein the detector identifies an expected path of said incoming ordnance.

13. The device of claim 1, wherein the ignition unit is configured to carry out said ignition in accordance with said predicted timing.

14. Method for interception of incoming ordnance, comprising:

detecting wind speed or wind direction or temperature, or humidity, or barometric pressure;

dispersing an undetonated cloud of detonatable material in relationship to an expected path of the incoming ordnance and using said detecting of wind speed or wind direction or temperature or humidity of barometric pressure to modify said dispersing;

detecting proximity of the incoming ordnance in relation to said undetonated cloud of detonated material;

timing an ignition of said undetonated cloud of detonatable material such that a detonation of said cloud may disrupt the incoming ordnance; and igniting said undetonated cloud according to said timing, thereby to disrupt the incoming ordnance.

15. The method of claim 14, comprising dispersing said undetonated cloud from a launched canister.

16. The method of claim 14, comprising dispersing said undetonated cloud from a rocket propelled canister, or from a canister fired from a barrel, or from a hose or a vehicle or a drone.

17. The method of claim 14, comprising dispersing a second undetonated cloud of detonatable material in a vicinity of said incoming ordnance.

18. The method of claim 14, wherein the undetonated cloud of detonatable material comprises droplets of one member of the group consisting of combustible material, gasoline, aviation fuel, and oxidiser.

19. The method of claim 14, wherein said undetonatable cloud comprises one member of the group consisting of combustible powder, aluminum powder and detonatable powder.

20. The method of claim 14, comprising modifying a location in which said cloud is dispersed to intercept said path.

21. Method for interception of incoming ordnance, comprising:

dispersing at least one drone, the at least one drone carrying material for forming an undetonated cloud of detonatable material to a location expected to intercept incoming ordnance;

detecting wind speed or wind direction or temperature, or humidity, or barometric pressure;

in the event of detecting approach of incoming ordnance, expelling said material to form said undetonated cloud at a location selected, in relationship to an expected path of the incoming ordnance to be able to disrupt the incoming ordnance if detonated according to a suitable timing, and igniting said undetonated cloud at said suitable timing, thereby to disrupt the incoming ordnance, and using said detecting of wind speed or wind direction or temperature or humidity or barometric pressure to modify said location selected; and in the event that no incoming ordnance is detected, retrieving said at least one drone.

* * * * *